US005607570A

United States Patent [19]

Rohbani

[11] Patent Number: 5,607,570

[45] Date of Patent: Mar. 4, 1997

[54] ELECTROPLATING SOLUTION

[76] Inventor: Elias Rohbani, 23721 Canzonet St., Woodland Hills, Calif. 91367

[21] Appl. No.: 331,443

[22] Filed: Oct. 31, 1994

[51] Int. Cl.[6] ..... C25D 3/38

[52] U.S. Cl. ..... 205/297; 205/291; 205/295

[58] Field of Search ..... 205/291, 293, 205/295–297

[56] References Cited

U.S. PATENT DOCUMENTS

| | | | |
|---|---|---|---|
| 2,355,070 | 8/1944 | Harford | 205/296 |
| 2,813,066 | 11/1957 | Ostrow | 205/297 |
| 3,227,638 | 1/1966 | Burnson et al. | 205/296 |
| 3,475,293 | 10/1969 | Haynes . | |
| 3,617,451 | 11/1971 | Slominski | 205/297 |
| 3,706,634 | 12/1972 | Kowalski . | |
| 3,706,635 | 12/1972 | Kowalski . | |
| 3,775,265 | 11/1973 | Bharucha et al. | 205/296 |
| 3,833,486 | 9/1974 | Nobel . | |
| 3,879,270 | 4/1975 | Kowalski . | |
| 3,914,162 | 10/1975 | Kowalski . | |
| 3,928,147 | 12/1975 | Kowalski . | |
| 3,974,045 | 8/1976 | Takahashi . | |
| 4,038,161 | 7/1977 | Eckles et al. | 205/297 |
| 4,310,392 | 1/1982 | Kohl | 205/297 |
| 4,376,685 | 3/1983 | Watson | 205/297 |
| 4,397,717 | 8/1983 | Acimovic . | |
| 4,948,474 | 8/1990 | Miljkovic | 205/297 |

FOREIGN PATENT DOCUMENTS

| | | |
|---|---|---|
| 1565654 | 5/1969 | France . |
| 36344 | 6/1965 | German Dem. Rep. . |
| 1051150 | 12/1966 | United Kingdom . |

*Primary Examiner*—T. Tung
*Attorney, Agent, or Firm*—John J. Posta, Jr.

[57] ABSTRACT

The improved aqueous, non-cyanide zinc electroplating solution prevents iron contamination during electroplating. The solution, in addition to water, has a copper salt, preferably copper sulfate, in a concentration of about 0.01–6% by weight of the solution, and the water-soluble reaction product of epichlorohydrin with Compound A, preferably in a concentration of about 16.67–26.67 gm./liter of solution. Compound A is a nitrogen-containing compound selected from aliphatic amine, unsubstituted heterocyclic nitrogen compound having at least two reactive nitrogen sites, and substituted heterocyclic nitrogen compound having at least two reactive nitrogen sites and 1–2 substitution groups selected from methyl, ethyl and amino groups. The reaction product, providing it includes the substituted or unsubstituted heterocyclic nitrogen compound, before use in the solution may be further reacted with a reagent of at least one of ammonia, aliphatic amine, polyamine or polyimine. A preferred reaction product is that of imidazole and epichlorohydrin in a molar ratio of about 0.7–1.7:1.

10 Claims, No Drawings

ELECTROPLATING SOLUTION

BACKGROUND OF THE INVENTION

1. Field of the Invention

The present invention generally relates to electroplating or electrodeposition of metals and more particularly to an improved aqueous non-cyanide electroplating solution useful as a strike bath for deposition of copper on zinc or other metals.

2. Prior Art

The electrodeposition of metals from aqueous solutions is well-known. Typically, an electroplating system includes an electroplating bath and two or more electrodes immersed in the bath. The cathode is the object to be plated. The anode may be either carbon or a piece of the metal to be plated on the cathode. When the anode is the plating metal, it is consumed during the electroplating process, providing a constant source of metal ions to the plating bath.

In electroplating metals such as copper on active metals such as zinc, it is necessary to first make the initial deposit from a strike bath in order to avoid immersion plating, that is, chemical deposition of metal. The strike bath ordinarily contains a sufficiently low concentration of metal ions so as to avoid the undesired chemical deposition of immersion plating.

Copper-containing strike baths usually utilize copper as a cyanide. Cyanides of other metals are also used in strike baths. However, cyanides are extremely dangerous to use. If the pH of the strike bath drops to 7.0 or becomes acidic (i.e., below pH 7.0), then there is real danger of producing hydrogen cyanide gas in the process. Hydrogen cyanide gas is colorless, odorless and deadly. Toxic metal cyanides are also hazardous. If the electroplater happens to absorb the dissolved cyanide, as through a skin cut or the like, injury or death can also occur. Moreover, the used cyanide-containing bath is difficult to dispose of safely without harming the environment. In addition, if an attempt is made to recover the metal cyanide from the used strike bath, special equipment and techniques must be employed which raise the overall cost of the electroplating operation.

Various attempts have been made in the past to carry out electroplating steps without the use of cyanides. See, for example, U.S. Pat. No. 3,475,293 which calls for the use of diphosphonates or monoamino lower alkylene phosphonates in electroplating divalent metal ions. See also U.S. Pat. Nos. 3,706,634 and 3,706,635 which utilize various types of phosphonic acids as complexing agents. Unfortunately, immersion plating may still occur. Metal deposited by immersion plating is spongy and has poor adhesion so that subsequent metal deposited electrically tends to crack and peel.

Newer cyanide-free solutions for use as strike baths are exemplified by U.S. Pat. No. 3,879,270 which utilizes cyanuric acid or a salt thereof, U.S. Pat. No. 3,914,162 which employs a carboxy alkylene amino di(methylene phosphonic acid) and U.S. Pat. No. 3,928,147 which employs an organophosphorus chelating agent. Such solutions work with indifferent results.

A problem not addressed by the prior art but which needs to be solved for best plating results is the unwanted contamination by iron which occurs during the electroplating of copper on zinc. The iron is typically derived from the parts which are to be plated. Once the iron begins to deposit during electroplating (which begins to occur noticeably after a few days of electroplating), it forms a metal complex with the desired metal being deposited, which complex weakens the adhesion between the metal being plated and the plating metal, specifically the adhesion between the copper being plated and the zinc being plated by the copper.

Accordingly, it would be highly desirable to be able to provide an improved electroplating bath, more particularly, a strike bath useful for the plating of copper on zinc or the like without interference from iron contamination and without the necessity of using harmful dangerous chemicals such as cyanides in the bath. Such bath should be inexpensive, efficient and easy to make up and dispose of without contamination of the environment and without risk to the plater.

SUMMARY

The improved aqueous, non-cyanide copper-containing electroplating solution of the present invention satisfies the foregoing needs. The solution is used as an electroplating bath and is simple to make up, easy and efficient to use and is easy to dispose of without danger to the environment and to the plater.

The solution or bath is substantially as set forth in the ABSTRACT OF THE DISCLOSURE. Thus, the solution employs (1) a copper salt, such as copper sulfate, (2) water, (3) a novel water-soluble compound, and (4) either potassium, sodium or lithium hydroxide or sodium carbonate. This compound is the reaction product of epichlorohydrin and Compound A. Compound A is a nitrogen-containing compound selected from the group consisting of straight chain or branched amine, unsubstituted heterocyclic nitrogen compound having at least two reactive nitrogen sites, or a similar compound substituted with 1–2 substitution groups selected from methyl, ethyl and amino groups.

The reaction product of epichlorohydrin and Compound A can also be further reacted with a reagent which is at least one of ammonia, aliphatic amine, polyamine and polyimine, before it is utilized in the electroplating solution of the present invention. The initial reaction between the epichlorohydrin and Compound A can take place under any suitable reaction conditions, for example, the following: these two chemicals can be chemically reacted together in solution in a mutual solvent at about 90° to about 140° F. for about 30 to about 240 mins. to form a desired product.

The subsequent reaction of this reaction product of epichlorohydrin and Compound A with the reagent which is one or more of ammonia, aliphatic amine, polyamine and polyimine can take place under any suitable conditions, for example, about 90°–140° F. for about 30–240 mins.

The water-soluble copper salt is preferably present in the aqueous solution in a concentration of about 0.01–6% by weight of the solution, while the water-soluble reaction product is preferably present in a concentration of about 9–50 grams per liter of solution and enough sodium, potassium or lithium hydroxide or sodium carbonate to bring the Ph between 9 and 14.

The most preferred reaction product utilizable in the improved plating solution of the present invention is the reaction product of about equimolar amounts of epichlorohydrin and imidazole. Other preferred examples of the reaction product are as set forth in the following detailed description.

DETAILED DESCRIPTION

The water-soluble copper salt utilized in the improved electroplating solution, which is most preferably used as a strike bath, preferably is copper sulfate ($CuSO_4.5H_2O$). Other suitable copper salts are the following: copper chloride, copper acetate and copper carbonate. The copper salt is preferably present in a small concentration of about 0.01–6% by weight of the solution. The remainer of the solution preferably is water, except for the reaction product described below.

The reaction product utilized in the electroplating solution of the present invention is the water-soluble product of the reaction between epichlorohydrin and a compound identified herein as Compound A. The net result is a true chemical reaction product, not merely a complex or mixture of ingredients.

Compound A is a nitrogen-containing organic compound selected from the group of consisting of the following, and mixtures thereof:

1) aliphatic chain amine;

2) unsubstituted heterocyclic nitrogen compound having at least two reactive nitrogen sites; and, 3) substituted heterocyclic nitrogen compound having at least two reactive nitrogen sites and having 1–2 substitution groups selected from methyl, ethyl and amino groups.

Preferred examples of the aliphatic amine of 1) above are the following:

dimethylamine, ethylamine, methylamine, diethylamine, triethyl amine, ethylene diamine and diethylenetriamine.

Preferred examples of the unsubstituted heterocyclic nitrogen compound of 2) are the following:

imidazole, pyrazole, 1, 2, 3 triazole, tetrozole, pyradazine, 1, 2, 4 triazole, 1, 2, 3 oxadiazole, 1, 2, 4 thiadiazole and 1, 3, 4 thiadiazole.

Preferred examples of the substituted heterocyclic nitrogen compound of 3) above are the following:

1-methylimidazole, 2-methylimidazole, 1,4-dimethylimidazole, 4-hydroxy,2-amino imidazole and 5-ethyl-4-hydroxyimidazole The most preferred examples of Compound A are the following:

imidazole, pyrazole, 1, 2, 3 triazole, tetrazole, pyridazine, 1, 2, 4 triazole, 1, 2, 3 oxadiazole, 1, 2, 4 thiadiazole and 1, 3, 4 thiadiazole and those derivatives thereof which incorproate 1 or 2 substitutents selected from the group consisting of methyl, ethyl, phenyl and amino groups, as are exemplified above.

As previously indicated, the reaction product used in the solution of the present invention is prepared by reacting Compound A with epichlorohydrin under any suitable reaction conditions. In one method, both of these materials are dissolved in suitable concentrations in a body of mutual solvent and reacted therein at, for example, about 45 to about 240 mins. The water-solution chemical product of the reaction can be isolated as by distilling off the solvent, and then can be added to the body of water which serves as the electroplating solution of the present invention, once the copper salt is dissolved therein. In another method, these two materials are placed in a body of water and heated to about 140° F. with constant vigorous stirring until they dissolve in the water as they react.

The molar ratio of Compound A to epichlorohydrin in the resulting reaction product is about 0.7–1.7:1, preferably about 1:1.

As indicated previously, the above-described reaction product can be further reacted with one or more selected reagents before the electroplating solution is completed by the addition of the copper salt. Thus, the described product can be further reacted with a reagent which is at least one of ammonia, aliphatic amine, polyamine and polyimine. Preferably, the reagent is at least one of ammonia, ethylenediamine, tetraethylene pentamine and a polyethyleneimine having a molecular weight of at least about 150, although other species meeting the definitions set forth herein can be used. The reaction can take place at elevated temperature in water with stirring.

For example, the reaction between the reaction product of epichlorohydrin and Compound A and the reagent of ammonia, aliphatic anime, and alyamine or polyimine can take place and can be carried out at a temperature of, for example, about 90° to about 140° F. for, example, about 45 to about 240 mins. The molar ratio between the reaction product of the Compound A-epichlorohydrin reaction and the reagent is preferably about 1:0.3–1.

Further aspects of the improved electroplating solution of the present invention are set forth in the following specific examples.

EXAMPLE I

In accordance with the present invention, a reaction product useful in the improved electroplating solution of the present invention was first formed by reacting 1 mole of imidazole (as Compound A) and 1 mole of epichlorohydrin under the following two separate conditions:: In run A, the imidazole and epichlorohydrin were first dissolved in a common solvent for both chemicals, ethyl alcohol. The reaction between these two chemicals was then initiated and completed over 240 mins. at 120° F., after which the alcohol was distilled off. In run B, the imidazole was disposed in a water bath heated to 140° F. and the epichlorohydrin was added dropwise with vigorous stirring over a 60 min. period. Thereafter, 16.67 gms. of this reaction product and 16.67 gms. of copper sulfate and enough sodium, potassium or lithium hydroxide or sodium carbonate to bring the Ph to 12.5 in run A were dissolved in a liter of water to make up the desired electroplating solution. In run B, the water which was already present was adjusted in amount to the same liter amount and the copper sulfate was dissolved therein.

The same concentrations of copper sulfate and the reaction product of Compound A and epichlorohydrin were present in run B as in run A.

For each of runs A & B, a clean steel panel of the following dimensions was then introduced into the Hull cell and used as the cathode in the Hull cell with a copper anode. Plating of the steel panel with a strike coating of copper from the aqueous solution was carried out under typical strike bath conditions, namely, at about 2 amps. electrical power and 140° F. over a 5 minute period. A bright, uniform, superior strike deposit of copper in a thickness of about 0.3 mils was formed on the steel panel. The panel showed good adhesion of copper thereto when it was subsequently subjected to conventional full electroplating in the Hull cell to a finished copper plating thickness of about 9 mils. The same results were obtained with runs A and B.

In a second series of runs substantially identical to those above-described for runs A and B, the reaction product was present, however, in a concentration of about 26.67 gms/liter, while the copper sulfate concentration remained at 16.67 gms/liter. Similar results were obtained under the same conditions as set forth above for runs A and B when copper was strike plated and then full electroplated on zinc and brass panels instead of steel panels. In further runs when the following water-soluble copper salts were substituted for the copper sulfate in the electroplating solution, comparable results were obtained:

copper carbonate, copper chloride, copper acetate, cuprous chloride.

Comparable results in further parallel runs were obtained only when the molar ratio of the imidazole to the epichlorohydrin was kept within the range of 0.7–1.7:1.

In separate further parallel runs pyrazole, 1, 2, 3 triazole pyridazine, 1, 2, 4-triazole 1, 2, 3 oxadizole, 1, 2, 4 thiadiazole and 1, 3, 4 thiadiazole were substituted for the imidazole in the same molar concentration with comparable results.

In further runs the following methyl, ethyl and amino group-substituted heterocyclics were substituted for the imidazole, in the same molar concentrations, with comparable results:

1-methylimidazole, 2-methylimidazole, 1,4-dimethylimidazole, 4-hydroxy,2-amino imidazole and 5-ethyl-4-hydroxyimidazole.

Additional parallel runs employed the following straight chain amines, polyamines and polyimines instead of imidazole with comparable results:

dimethylamine, ethylamine, methylamine, diethylamine, triethyl amine, ethylene diamine and diethylenetriamine.

Accordingly, the utility of the present electroplating strike solution was established. Even when the solution was used over a multi-day period, no evidence of interference by iron ions from the plate being electroplated with the firm adhesion of the strike plating being deposited was observed. The electroplating solution of the present invention did not contain cyanide and therefore was safe to handle and to discard after use.

EXAMPLE II

Further samples of useful electroplating solutions in accordance with the present invention were prepared under the conditions and parameters as set forth in Example I, except that no amine was used as Compound A. Instead, in each instance reaction product of the substituted or unsubstituted heterocyclic compound with epichlorohydrin was subsequently reacted with a reagent which was one or more of ammonia, an aliphatic amine, polyamine or polyimine in a molar ratio of heterocyclic compound-epichlorohydrin reaction product to reagent of about 1: 0.3–1 under the following general conditions:

a temperature of 90° to 140° F., with agitation and reflux over a period of about 45–240 minutes.

As a specific example, the reaction product of Compound A and epichlorohydrin was first dissolved with the reagent in water in the proper molar ratio and then was reacted therewith as follows: for about 45 min. at a temperature of about 140° F., while refluxing the solution. The final product of the reaction between he reaction product of Compound A and epichlorohydrin and the reagent while still in the water was then ready for introduction of copper sulfate therein to form the desired electroplating solution.

In separate runs ammonia, ethylene diamine, tetraethylene pentamine and a polyethyleneimine having a molecular weight about 150 were employed as the reagent described above. Results comparable to those of Example I were obtained, when electroplating under the same conditions as in Example I were carried out.

Further features of the improved electroplating solution of the present invention are as set forth in the foregoing. Various modifications, changes, alterations and additions can be made in the improved electroplating solution of the present invention, its components and parameters. All such modifications, changes, alterations and additions as are within the scope of the appended claims form part of the present invention.

What is claimed is:

1. An improved, aqueous electroplating solution containing no cyanide, said solution consisting of:

a) copper salt;

b) water;

c) either potassium, sodium, or lithium hydroxide or sodium carbonate; and, d) the reaction product of epichlorohydrin and Compound A, which Compound A is a nitrogen-containing compound selected from the group consisting of 1) straight chain amine, 2) unsubstituted heterocyclic nitrogen compound having at least two reactive nitrogen sites, and 3) substituted heterocyclic nitrogen compound having at least two reactive nitrogen sites and at least one and not more than two substitution groups selected from methyl, ethyl and amino groups, said solution preventing the build-up of iron contamination during electroplating.

2. The improved electroplating solution of claim 1 wherein said Compound A is selected from the group consisting of imidazole, pyrazole, 1, 2, 3 triazole, pyridazine, 1, 2, 4 triazole, 1, 2, 3 oxadiazole, 1, 2, 4 thiadazole, 1, 3, 4 thiadazole and derivatives thereof having at least one and not more than two substitutents selected from the groups consisting of methyl, ethyl and amino groups.

3. The improved electroplating solution of claim 1 wherein said copper salt comprises at least one of copper sulfate, copper acetate, copper chloride and copper carbonate, and wherein said reaction product comprises the reaction product of epichlorohydrin and imidazole.

4. The improved electroplating solution of claim 1 wherein said copper salt is present in said solution in a concentration of about 0.01 to about 6 percent by weight of said solution and wherein said reaction product is present in said solution in a concentration of about 9 to about 50 grams per liter.

5. The improved electroplating solution of claim 1 wherein said Compound A is in a molar ratio to said epichlorhydrin of about 0.7–1.7:1.

6. The improved electroplating solution of claim 5 wherein said molar ratio is about 1:1.

7. The improved electroplating solution of claim 6 wherein said Compound A is imidazole, wherein said reaction product is present in said solution in a concentration of about 16.67–26.67 gm./liter, wherein said copper salt is copper sulfate, which is present in said solution in a concentration of about 16.67 gm./liter.

8. An improved, aqueous electroplating solution containing no cyanide, said solution consisting of:

a) copper salt;

b) water;

c) either potassium, sodium or lithium hydroxide or sodium carbonate; and, d) an agent which prevents the build-up of iron contamination during electroplating, said agent having been formed by first reacting epichlorohydrin and Compound A and thereafter reacting the epichlorohydrin- Compound A reaction product with at least one of ammonia, aliphatic amine, polyamine and polyimine, said Compound A being a nitrogen-containing compound selected from the group consisting of 1) straight chain amine, 2) unsubstituted heterocyclic nitrogen compound having at least two reactive nitrogen sites, and 3) substituted heterocyclic nitrogen compound having at least two reactive nitrogen sites and at least one and not more than two substitution groups selected from methyl, ethyl and amino groups.

9. The improved electroplating solution of claim 8 wherein the molar ratio of said reaction product to said ammonia, aliphatic amine, polyamine or polyimine reagent is about 1:0.3–1.

10. The improved electroplating solution of claim 8 wherein said amine is methylamine, wherein said polyamine is one of ethylenediamine and tetraethylene pentamine and wherein said polyimine is polyethylenimine having a molecular weight of at least about 150.

* * * * *